US005755110A

United States Patent [19]

Silvas

[11] Patent Number: 5,755,110

[45] Date of Patent: May 26, 1998

[54] COOLING VEST WITH ELONGATED STRIPS CONTAINING A POLYMER ABSORBING MATERIAL

[76] Inventor: Cesar F. Silvas, 3167 N. Corona Pl., Nogales, Ariz. 85621

[21] Appl. No.: 721,645

[22] Filed: Sep. 26, 1996

[51] Int. Cl.[6] ..... F25D 23/12

[52] U.S. Cl. ..... 62/259.3; 2/102; 2/458; 165/46

[58] Field of Search ..... 62/259.3, 530; 2/102, 458; 165/46; 607/108, 114, 112

[56] References Cited

U.S. PATENT DOCUMENTS 5,606,746 3/1997 Shelton et al. ..... 2/102

*Primary Examiner*—John M. Sollecito
*Attorney, Agent, or Firm*—LaRiviere, Grubman & Payne

[57] ABSTRACT

A cooling vest having a plurality of elongated pocket partitions formed on front side and backside vest portions for containing beads of polyacrylamide material that absorb a liquid, such as water, to form a gel that may be chilled, or frozen, to provide a cooling effect on the upper torso of a human wearer. The cooling effect is facilitated by non-impervious properties of a double layer fabric used in construction of the vest that permit evaporation. The front side portions of the vest also provide surface area upon which to add fashion appeal ornate designs, or on which utility pockets are formed. The vest is further provided with a collar member having a partition for containing polymer material. The upper shoulder blade area of the backside of the vest is divided from the lower lumbar area by a stitching pattern that ornate the backside of the vests and that separates the upper and lower polymer containing partitions. The shoulder blade pocket partitions are thinner because these partitions contain less polymer material than the lower partitions that define the lumbar region of the vest. The lower lumbar area of the vest is formed to contain more of the polymer material primarily to provide an additional lumbar support feature. The underarm regions of the vest include band pocket partitions to especially provide cooling to that part of a user's body. An alternate vest embodiment includes mesh fabric strips adjacent each pocket partition.

17 Claims, 5 Drawing Sheets

COOLING VEST WITH ELONGATED STRIPS CONTAINING A POLYMER ABSORBING MATERIAL

FIELD OF THE INVENTION

The present invention relates to an article of clothing commonly referred to as vests. More particularly, the present invention relates to vests that are designed to facilitate cooling a wearer. Even more particularly, the present invention relates to vests that are designed to facilitate cooling a wearer by chemical action.

DESCRIPTION OF THE PRIOR ART

Vests designed to facilitate cooling a wearer are known to exist. U.S. Pat. No. 2,855,758 teaches a chemical cooling garment that utilizes chemicals having a negative heat of solution, such as ammonium nitrate and potassium thiocyanate. The garment requires an absorbent thread in contact with the wearer to conduct moisture, in the form of perspiration, into an impervious membrane containing the chemical, wherein the moisture causes the chemical to go into solution to produce a cooling effect. U.S. Pat. No. 3,610,323 teaches a cool coat having a tubular network for being filled with a refrigerant liquid. The tubular network is provided with capillary openings that allow the liquid to evaporate, and thus cool the wearer of the coat. U.S. Pat. No. 3,429,138 teaches a cooling vest formed in the shape of a wide band body. The body is provided with a plurality of rectangular three ply strips comprising a metallic foil, an absorbent evaporator material, such as sponge, and a outer ply of fabric. Fastening side straps and shoulder straps are provided. In use, the vest is dunked in water, or other cooling fluid, and worn over an outer garment. Cooling is produced by evaporation. Other patents teaching cooling garments include U.S. Pat. Nos. 4,580,408, 4,998,415, 5,201365 and 5,201,365. These patents are complex and require the use of interface structures for moving the coolant, special compressor equipment, or require the use of layers of sponge-like water absorbing materials. U.S. Pat. Nos. 5,305,471 and 5,484,448 teach the use of gel cooling packs that are inserted into pockets that include a metalized breathable material in the outer pocket walls. U.S. Pat. No. 5,415,222 teaches a phase change material (solid to liquid), such as a paraffinic compound, contained in pouches, or macrocapsules, which are inserted in pockets of a vest cooling garment. The phase change material is selected in accordance with a desired melting point to control and maximize the cooling effect.

In spite of the foregoing prior art patents teaching cooling vest, they are not commercially available for wide usage. The reasons are believed to be due to high cost, complex structures, heavy, too cold during initial use, and in general lack structure directed at fashion appeal. Thus, a need is still seen to exist for a cooling vest design that is simple to produce and fashionably appealing.

It is therefore a primary object of this invention is to provide a vest design that uses a polymer material that produces a cooling effect by evaporation of water absorbed by the polymer through non-impervious pockets formed on the vest that contain the polymer.

A related primary object of the present invention is to provide a vest design as proposed above that is lightweight and that contains a polymer in the non-impervious pockets that is characterized by having liquid absorption capability and slow evaporation characteristics to prolong the cooling effect.

Yet another related primary object of the present invention is to provide a vest design that has fashion appeal for promoting wide usage.

SUMMARY OF THE INVENTION

Accordingly, the foregoing objects are accomplished by providing a vest comprising a plurality of elongated partitions formed for containing beads of polyacrylamide material, herein referred to as polymer material, that absorb water to form a gel which is then chilled, or frozen, according to the user's cooling preference. The beads of polyacrylamide are commercially known as anionic polyacrylamide powder and have a chemical name of copolymer of potassium acrylamide and potassium acrylate, and are commercially available from Hydo-Growth Technology, Inc., Tucson, Ariz. The beads of polyacrylamide are non-hazardous, and are a white granular solid, sized 1 mm to 4 mm, that are insoluble in water, but that swells in water to a gel consistency that is two to three times the dry state size. Aside from the above, the chemistry associated with the beads of polyacrylamide is not known to applicant and will not be elaborated on herein except to the extent needed to discuss its use in filling the vest's elongated partitions and capitalizing on the bead's polymeric water absorption and evaporation properties to provide a cooling effect. In one embodiment, the vest structure comprises a front and back, double layer fabric structure that forms an inner liner and an outerwear surface part of the vest, and which structure is selectively sewn at spaced intervals to provide the partitions within which the polymer material is contained. The polymer material in these partitions is preferably of the larger 2 mm to 4 mm bead size. The portions of the vest which do not require the polymer containing partitions are preferably single layer fabric, but may be formed also from double layer material that is void of the polymer. Another vest embodiment of the present invention provides a horizontal mesh fabric strip arrangement along with an alternating vertical single layer mesh fabric/polymer pocket partition arrangement. This alternative vest embodiment enhances movement of air towards to, and away from the inner fabric liner of the vest structure to further enhance the evaporation of the liquid from the saturated polymer beads and provide a better cooling effect. The frontside parts of the vest and the backside of the vests are delineated by interconnecting shoulder panel strips that are void of the polymer material, and which provide a surface area for adding an ornate design that will enhance fashion appeal. The shoulder panel strips are preferably formed from highly absorbent fabric, such as a fabric consisting of 90% cotton, 6% elastic material, and 4% nylon, to enhance dissipation of upward going body heat and absorption of body perspiration, and provide a comfortable fit. The front side portions of the vest, in addition to the polymer containing elongated partitions, also provide surface area upon which to add fashion appeal ornate designs, or on which utility pockets are formed. The neck area of the backside of the vest is provided with a collar member formed of double layer material sewn to delineate a partition for containing the cooling polymer material. The polymer in the collar member partition is preferably of the smaller, 1 mm to 2 mm bead size. The upper shoulder blade area of the backside of the vest is divided from the lower lumbar area of the vest by a stitching sewn in a pattern that ornates the backside of the vests and that functionally separates the upper and lower polymer containing partitions. The polymer containing partitions on the backside of the vest are formed to span from the shoulder panel strips downward to the waist end of the vest. The polymer containing partitions on the shoulder blade portion of the vest are thinner in cross sectional area by virtue that these partitions contain less polymer material than the lower partitions that define the lumbar region portion of the vest. The lower lumbar area of the vest is formed to contain more of the polymer material primarily to provide an additional lumbar support feature. As discussed previously, the polymer bead size preferably used throughout the vest pocket partitions, except the collar member pocket partition, are the larger 2 mm to 4 mm bead size. The larger sized polymer beads (2 mm–4 mm) are prone to forming a more viscous gel mass than the smaller sized beads (1 mm to 2 mm). The higher viscosity polymer gel is preferred to avoid settlement of the polymer beads in the lower portion of the vest's elongated pocket partitions, while the lower viscosity polymer gel is adequate for the collar pocket partition. A horizontal pocket partitions pattern on the vest structure may obviate the concern for settlement of the polymer gel. Additionally, the more viscous gel facilitates being kneaded to allow the user to shift the gel nearest the inner fabric liner to the outerwear side to effectively provide cooler polymer beads next to the user's body. The sides of the front and back portions of the vest structure are not permanently connected to each other, but are attachable by strap means. The region defining the openings for the arms on the front and back portions of the vest are provided with a peripheral band partition for containing the polymer material. The arm band partitions are formed to extend downward towards the underarm region to especially provide cooling to that part of a user's body.

Therefore, to the accomplishments of the foregoing object, the invention consists of the foregoing features hereinafter fully described and particularly pointed out in the claims, the accompanying drawings and the following disclosure describing in detail the invention, such drawings and disclosure illustrating but one of the various ways in which the invention may be practiced.

DESCRIPTION OF THE PREFERRED EMBODIMENT OF THE INVENTION

Figure 1:
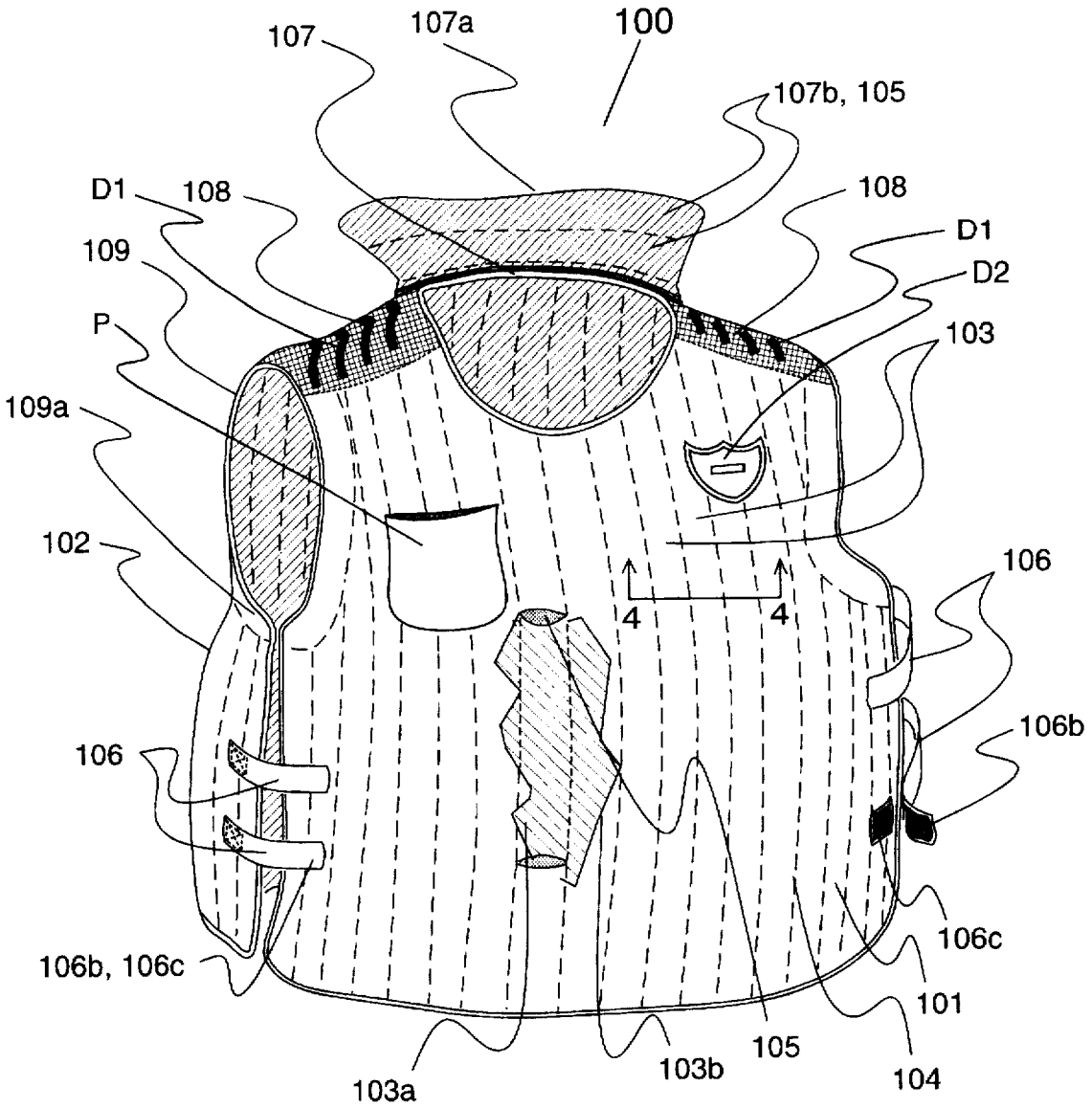
FIG. 1 is a perspective frontside view of a vest in accordance with the present invention showing the plurality of elongated partitions that contain the polyacrylamide beads, the collar member having a partition strip that contains the polyacrylamide beads, the shoulder panel strips, the arm band partition and the side attachment straps.
Figure 5:
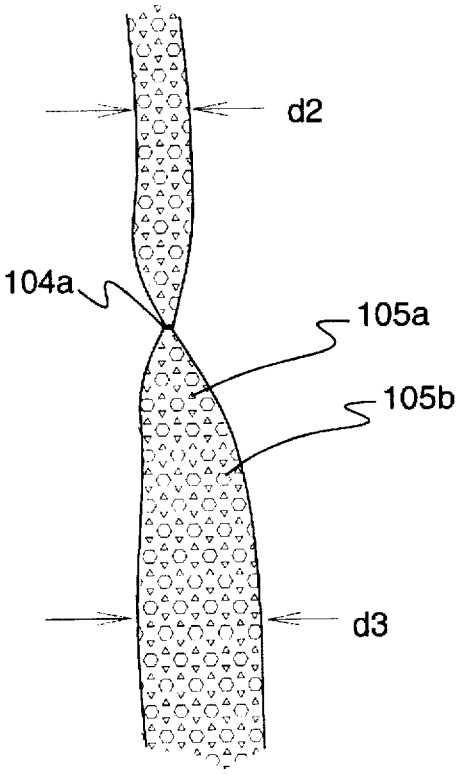
FIG. 5 is a cross-sectional view taken along line 5—5 in FIG. 2 showing the varying thickness construction of the backside of the vest to not only provide cooling partitions but also to provide lumbar support for the user.

FIG. 1 shows vest structure 100 comprising a frontside member 101 and a backside member 102. Frontside member 101 and backside member 102 are fixedly connected at a neck opening region 107 by shoulder strip portions 108 and are detachably connected at left and right sides by strap means 106 comprising attached end 106*a*, and detachable hook and loop pad ends 106*b*, 106*c*. The vest structure is preferably formed from double layer cotton fabric material sewn at spaced intervals by stitching 104 to form a plurality of elongated pocket partitions 103. The double layer construction results in an inner liner portion 103*a* and an outerwear portion 103*b*. Pocket partitions 103 are preferably spaced at a distance d1 measuring 3.5 cm by stitching 104 and may vary in length up to 60 cm to facilitate forming vest sizes small, medium, large, X-large and XX-large. The pocket partitions 103 are fillable with polyacrylamide beads 105 to produce a filled partition body having a thickness d2, d3 that varies according to the saturation level of the cooling fluid (preferably water) absorbed by the polymer beads and the quantity of the polymer beads packed in the partitions. In this regard, polymer beads 105 are depicted as 105*a* for substantially dry polymer beads ranging in size from 1 mm to 4 mm and 105*b* for maximally saturated polymer beads. As discussed previously, the size of the polymer beads in pocket partitions 103 are preferably in the larger 2 mm to 4 mm size. The amount of polymer beads packed within pocket partitions 103 is determined according to the desired thickness of the fully saturated polymer beads to effect a thickness d2 of at least 0.60 cm for the majority of the vest body and a thickness d3 of at least 1.2 cm for the lower lumbar region of the backside of the vest 100, see generally FIGS. 3 and 5. The cooling effect produced by vest structure 100 is based on evaporation of a cooling fluid, preferably water, used to saturate the polymer beads. Cotton (100%) fabric, commercially known as BROADCLOTH Natural Charm available from Robbins Fabrics in Montebello, Calif., has been found to produce a non-impervious environment for facilitating evaporation of the cooling fluid used to produce the cooling effect in accordance with the present invention. A 65% cotton, 35% polyester fabric commercially known as TRIMODE Spring Night, also available from Robbins Fabrics in Montebello, Calif., has also been found to produce a non-impervious environment for facilitating evaporation of the cooling fluid from the saturated polymer beads. Other commercially available porous fabrics such as COOLMAX* (a registered trademark of Du Pont Company) also produces a non-impervious environment for facilitating evaporation of the cooling fluid from the saturated polymer beads and may be used in fabricating liner portion 103*a* and outerwear portion 103*b* of vest structure 100.

Figure 2:
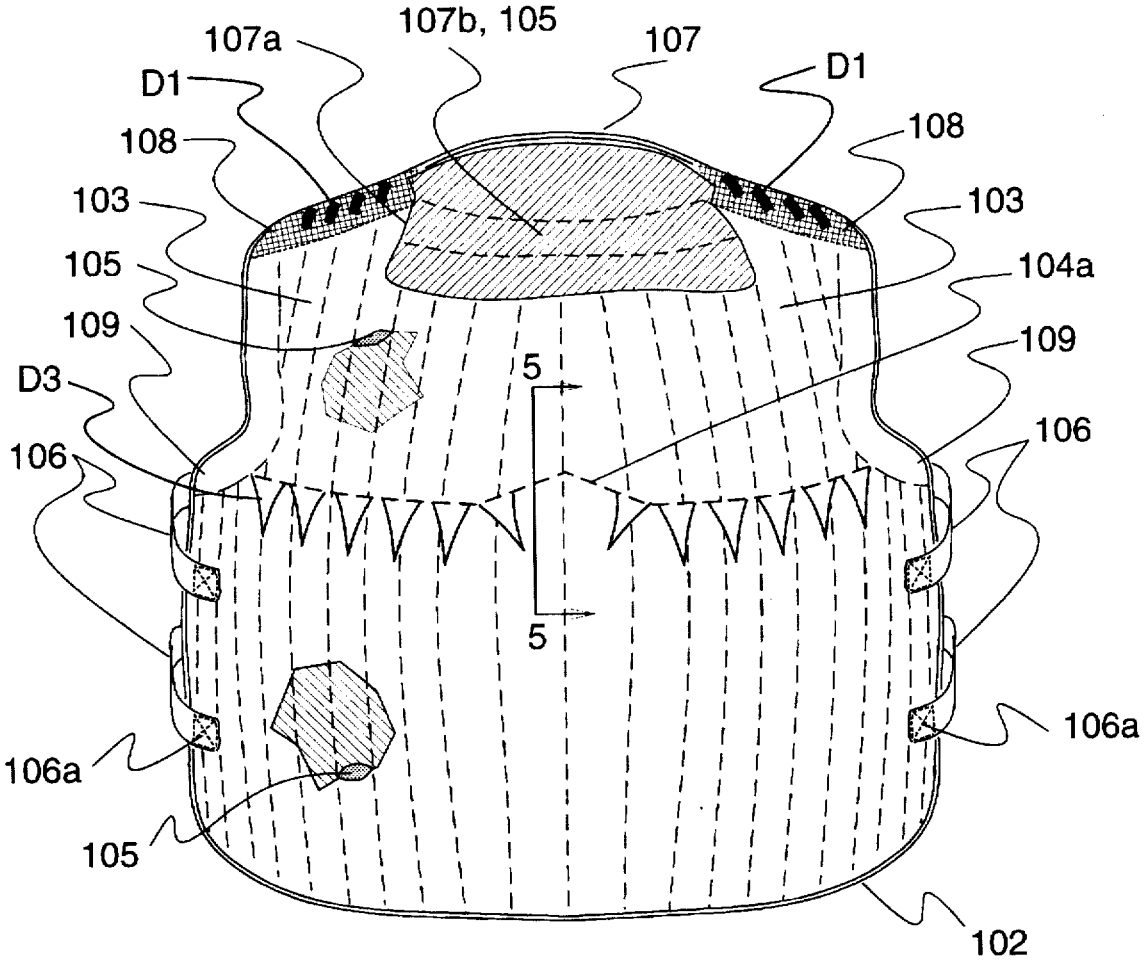
FIG. 2 shows a backside view of the vest structure in accordance with the present invention, showing, in particular, the ornate stitching that divides the upper and lower portions of the vest that define differing thickness of polymer-containing partitions.

FIG. 1 also shows vest structure 100 having a collar member 107*a* formed with pocket partitions 107*b* for containing polymer beads 105. Collar 107*a* is designed to provide a cooling effect by forming a non-impervious evaporative environment for fluid saturated polymer beads 105 contained within the pocket partitions 107*b*. As discussed previously, the polymer in the collar member pocket partition 107*b* is preferably of the smaller, 1 mm to 2 mm bead size. Collar member 107*a* is formed from the same non-impervious fabric as the rest of the vest. The collar member 107*a* may be formed for being detachable from the neck opening region 107. However, the collar member 107*a* is preferably in an attached state in that it is viewed as an important additional cooling feature of the vest structure. Similarly, vest structure 100 provides yet another cooling feature by having a circular pocket partition band 109 with underarm portions 109*a* formed about the arm opening peripheral region for containing the cooling polymer material 105. FIGS. 1 and 2 also show vest structure 100 having fashion appeal design elements, such as a utility pocket P and ornate designs D1, D2 and D3 as means for enhancing commercial activity.

FIG. 2 shows a backside view of the vest structure 100 in accordance with the present invention, showing, in particular, stitching 104*a* that divides the upper and lower portions of the vest that define differing thickness of polymer-containing partitions 103. The stitching 104*a* is preferably sewn in a pattern that ornates the backside of the vests and may be exaggerated, as depicted by ornate element D3. Stitching 104*a* functionally separates the upper and lower polymer containing partitions. The polymer containing partitions 103 on the backside of the vest are formed to span from the shoulder panel strips 108 downward to the waist end of the vest. As best seen by referring to FIG. 5, the polymer containing partitions on the shoulder blade portion measure a thickness d2 which is thinner than the thickness d3 for the lower partitions that define the lumbar region portion of the vest. As discussed above, the polymer containing partitions on the shoulder blade portion of the vest are thinner in cross sectional area by virtue that these partitions contain less polymer material than the lower partitions that define the lumbar region portion of the vest. The lower lumbar area of the vest is formed to contain more of the polymer material primarily to provide an additional lumbar support feature in addition to the cooling feature.

Figure 3:
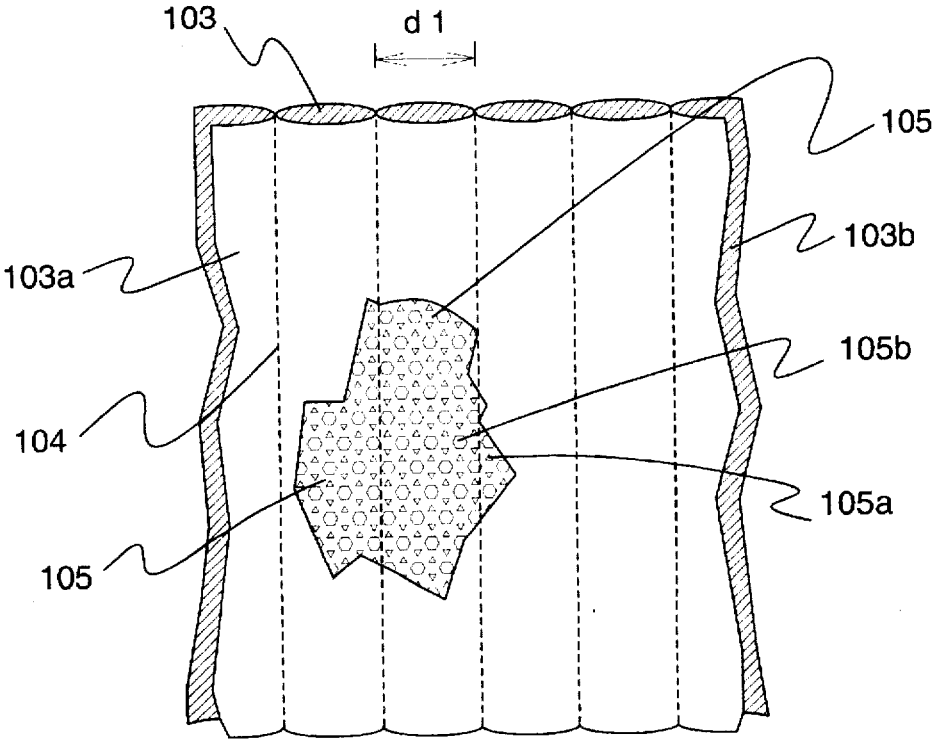
FIG. 3 is section view of the double layer fabric structure showing the elongated partitions formed by stitching and showing in cutaway view hydrated (swollen) polyacrylamide beads and dry polyacrylamide beads that fill the partitions.
Figure 4:
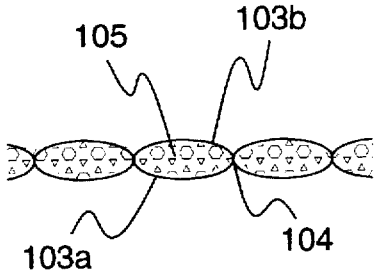
FIG. 4 shows a cross-section view taken along line 4—4 in FIG. 1 showing the inner liner and the outer vest surface sewn at spaced intervals to form the partitions adapted for containing the polyacrylamide beads.
Figure 4A:
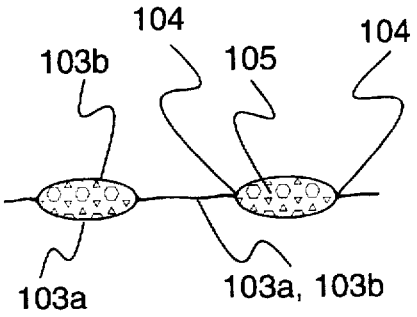
FIG. 4*a* shows a cross-sectional view of an alternative vest construction showing the inner liner and the outer vest surface sewn at wider spaced intervals than shown in FIG. 4 to form the partitions adapted for containing the polyacrylamide beads.
Figure 6:
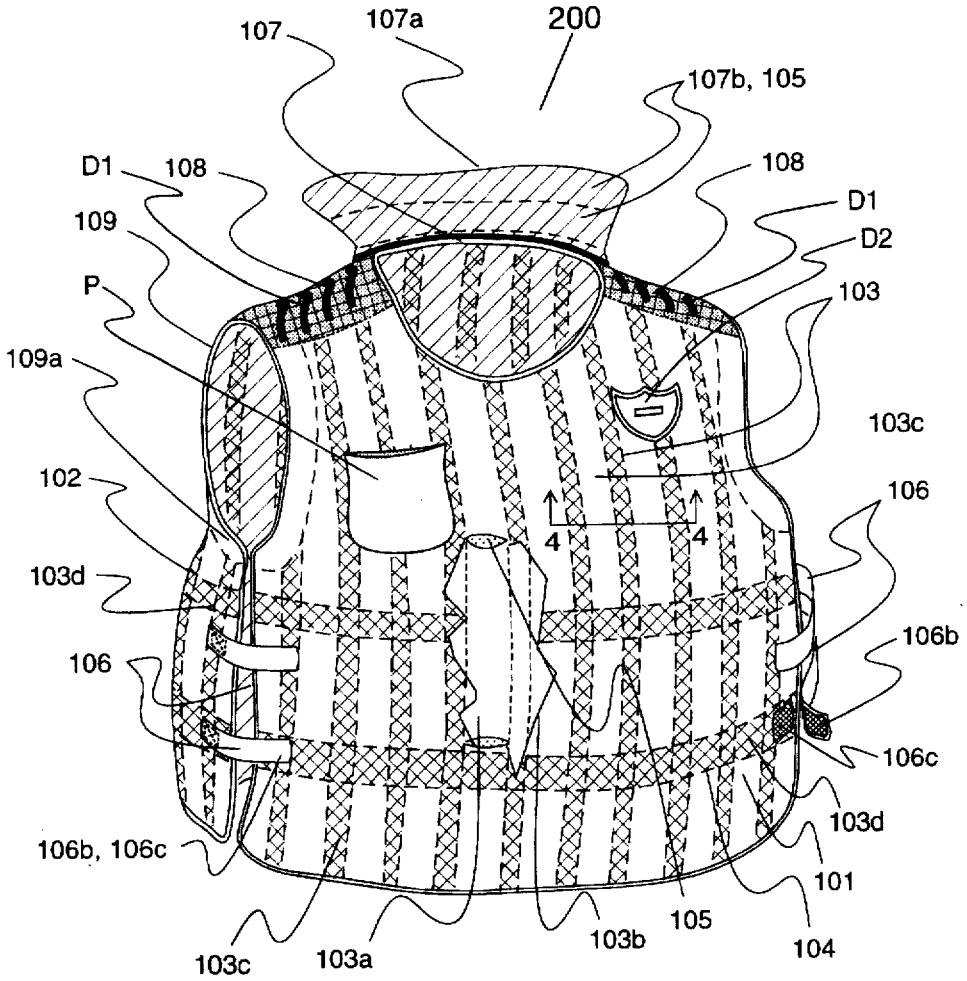
FIG. 6 is a perspective frontside view of an alternative embodiment of the vest structure shown in FIG. 1 illustrating the plurality of front and back elongated pocket partitions spaced apart by elongated strips of mesh fabric and having a pair of frontside horizontally positioned strips of a mesh fabric.
Figure 7:
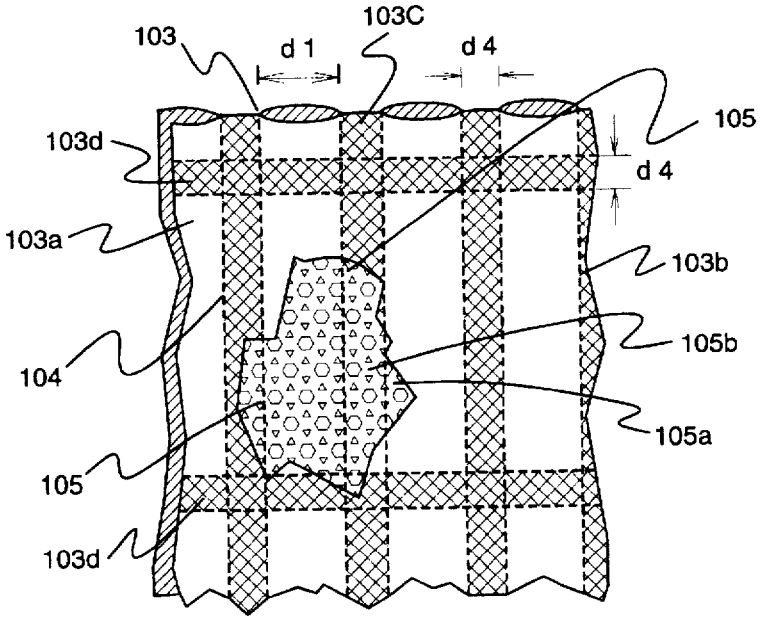
FIG. 7 is section view of the alternative vest embodiment shown in FIG. 6 illustrating the plurality of front elongated pocket partitions spaced apart by elongated strips of mesh fabric and also showing the horizontally positioned strips of a mesh fabric.
Figure 8:
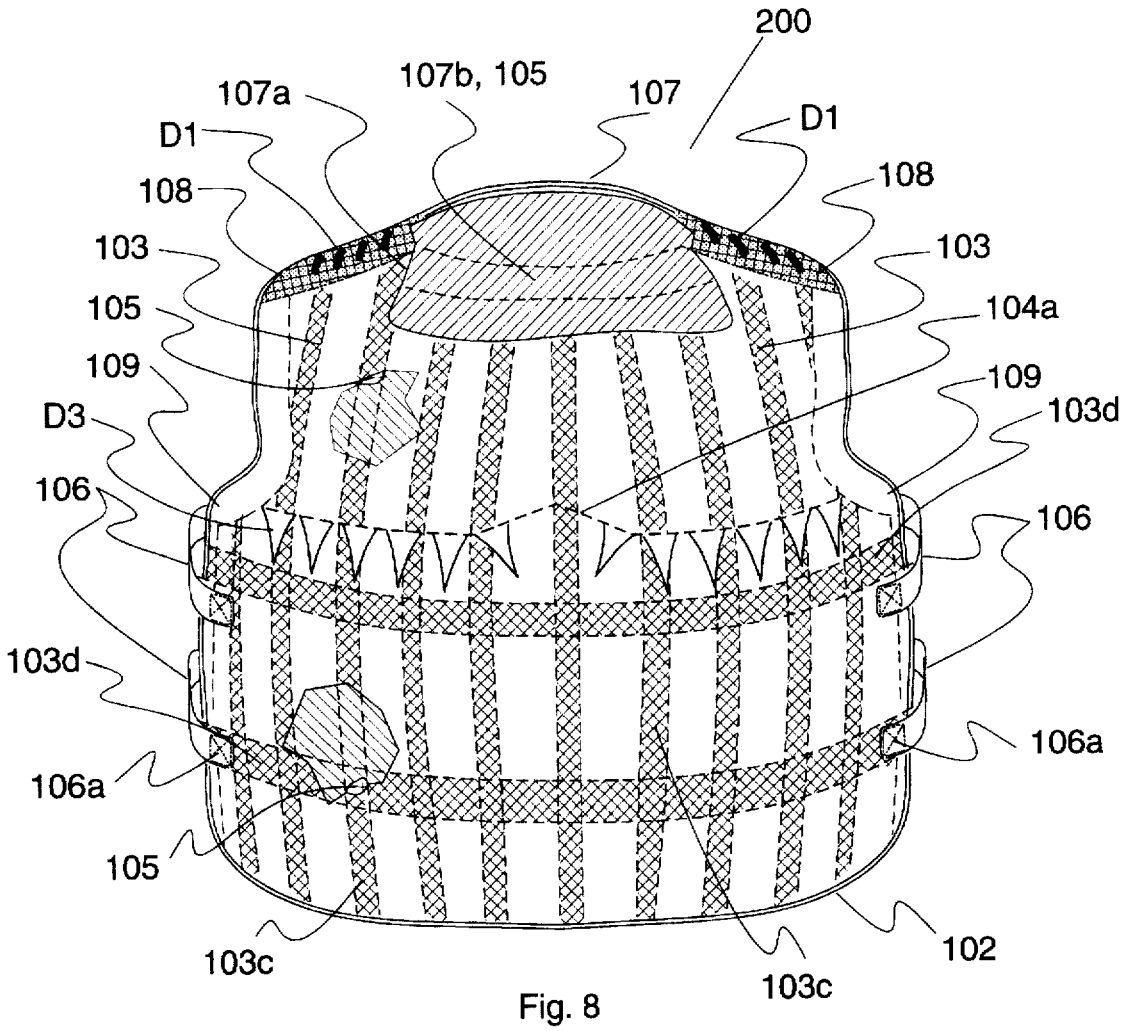
FIG. 8 shows a backside view of the vest structure shown in FIG. 1, illustrating the alternating vertically positioned backside mesh fabric strips and the backside horizontally positioned strips of a mesh fabric.
Figure 9:
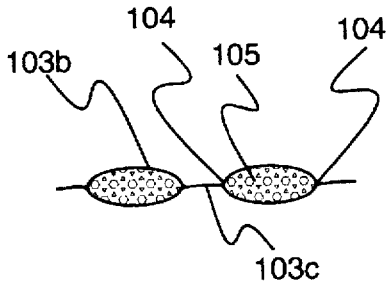
FIG. 9 shows a cross-section view taken along line 9—9 in FIG. 6 showing the polymer filled pocket partitions 103 spaced apart by strips of mesh fabric 103*c*.

FIG. 3 shows a section of the double layer fabric structure used in producing vest structure 100. In particular, the elongated pocket partitions 103 are shown as being formed by stitching 104 and for being used in containing the polyacrylamide beads 105. The present invention utilizes the absorption property of the contained polyacrylamide beads, namely that the polymer material will increase in size from a dry state 105*a* (which, by example only, may range in granule, or bead, size from 1 mm to 4 mm), to a hydrated state 105*b* (swelling typically two to three times the dry state bead size) upon being submerged in a liquid, such as water. In use, the saturated polymer beads within the confines of pocket partitions 103 are cooled prior to wearing the vest structure. The amount of cooling is controlled by the wearer of vest 100 and may include merely chilling the saturated vest structure above the freezing point of the cooling liquid used, or may include freezing the liquid in the saturated polymer beads. Preferably, the cooling procedure is one that produces a chilled vest that can be worn for a period of at least two hours. As an example, for the above described pocket partition with dimensions of d1=3.5 cm, d2=0.6 cm and d3=1.2 cm having a partition length of 16 inches (essentially an X-large size vest), and containing one (1) pound of polyacrylamide beads throughout the pocket partitions, was found to provide a two hour cooling period, beginning with a frozen state of water-saturated polymer beads. While the preferred embodiment of vest structure 100 comprises pocket partitions 103 spaced as illustrated in FIG. 3 and shown in cross-section in FIG. 4, vest structure 100 may also be formed as shown in FIG. 4*a*. There, an alternative vest construction is shown having the inner liner 103*a* and the outerwear vest fabric layer 103*b* sewn with stitching 104 at wider spaced intervals than shown in FIG. 4. Essentially, a pocket partition is formed but is void of the polymer beads. This alternative design facilitates controlling the weight of the vest structure 100 by selectively filling the formed pocket partitions 103 with the polymer beads 105. FIGS. 6 and 8 show an alternative vest design 200 whereby the pocket partitions 103 are formed spaced apart by strips of mesh fabric 103*c* and whereby a plurality of horizontally positioned cross strips 103*d* of mesh fabric are formed to enhance the evaporative capability of the vest structure. As shown in FIGS. 7 and 9, the width d4 associated with mesh fabric strip 103*c* and 103*d* is preferably one-half (½) the width associated with the width of the pockets 103.

Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus.

I claim:

1. A vest apparatus improved for providing temporary cooling comfort to a human wearer, said vest having a frontside vest portion, a backside vest portion, opposing shoulder portions, said shoulder portions interconnecting said frontside vest portion to said backside vest portion, said interconnected frontside and backside vest portions defining a neck opening between said shoulder portions, said frontside and backside vest portions each having respective opposing right and left sides, said right and left sides having attachment means for facilitating wearer manipulation to effect a comfortable fit, said improvement comprising:

a double layer of non-impervious fabric shaped for constructing said frontside vest portion and said backside vest portion, each of said constructed frontside and backside vest portion forming a respective inner fabric liner and outerwear fabric layer;

a stitching arrangement for joining said inner fabric liner to said outerwear fabric layer;

a plurality of elongated pocket partitions formed on said frontside and backside vest portions by said stitching arrangement, said pocket partitions defining a volume; and a pre-determined amount of polyacrylamide beads contained within each formed pocket partition, said amount of polyacrylamide beads being saturated with less than 1% by weight of a saturating liquid and being evenly distributed throughout each said formed pocket partitions and occupying less than 50% of said defined volume in each pocket partition, said polyacrylamide beads being porous and capable of further absorbing a liquid, through said non-impervious double layer fabric, and swelling to form a gel mass that fills 100% of said defined volume in each pocket partition.

2. A vest apparatus improved for providing temporary cooling comfort to a human wearer as described in claim 1, further comprising:

a collar member attached to said backside vest portion about said neck opening, said collar member also being formed from a double layer of non-impervious fabric and having stitching delineating at least one pocket partition having a defined volume; and a pre-determined amount of polyacrylamide beads contained within said at least one pocket partition.

3. A vest apparatus improved for providing temporary cooling comfort to a human wearer as described in claim 1, further comprising:

a transverse stitching arrangement located on said backside vest portion, said transverse stitching arrangement delineating an upper back vest portion having upper pocket partitions and a lumbar vest portion having lower pocket partitions, and a greater amount of said polyacrylamide beads being contained in said lower pocket partitions than in said upper pocket partitions, such that in a saturated state, said polyacrylamide beads in said lower pocket partitions produce a greater, thicker mass of swollen polymer gel than said polyacrylamide beads in said upper pocket partitions, said lumbar vest portion containing said saturated polyacrylamide beads forming a lumbar support vest portion.

4. A vest apparatus improved for providing temporary cooling comfort to a human wearer as described in claim 1, further comprising:

a peripheral pocket partition formed about both vest arm opening portions, each said peripheral pocket partition having an extended portion for contacting an underarm region of a user; and each said peripheral pocket partition containing a respective amount of said polyacrylamide beads for being saturated with a liquid.

5. A vest apparatus improved for providing temporary cooling comfort to a human wearer, said vest having a frontside vest portion, a backside vest portion, opposing shoulder portions, said shoulder portions interconnecting said frontside vest portion to said backside vest portion, said interconnected frontside and backside vest portions defining a neck opening between said shoulder portions, said improvement comprising:

a plurality of elongated pocket partitions on said frontside and backside vest portions formed from a double layer of non-impervious fabric, said pocket partitions defining a volume;

a plurality of mesh fabric strips sewn adjacent each said elongated pocket by a stitching arrangement;

a pre-determined amount of polyacrylamide beads contained within each said formed pocket partition, said amount of polyacrylamide beads being saturated with less than 1% by weight of a saturating liquid and being evenly distributed throughout each said formed pocket partitions and occupying less than 50% of said defined volume in each pocket partition, said polyacrylamide beads being porous and capable of further absorbing a liquid, through said non-impervious double layer fabric, and swelling to form a gel mass that fills 100% of said defined volume in each pocket partition;

a collar member attached to said backside vest portion about said neck opening, said collar member also being formed from a double layer of non-impervious fabric and having stitching delineating at least one pocket partition having a defined volume; and a pre -determined amount of said polyacrylamide beads contained within said at least one pocket partition.

6. A vest apparatus improved for providing temporary cooling comfort to a human wearer as described in claim 5, further comprising:

a transverse stitching arrangement located on said backside vest portion, said transverse stitching arrangement delineating an upper back vest portion having upper pocket partitions and a lumbar vest portion having lower pocket partitions; and a greater amount of said polyacrylamide beads being contained in said lower pocket partitions than in said upper pocket partitions, such that in a saturated state, said polyacrylamide beads in said lower pocket partitions produce a greater, thicker mass of swollen polymer gel than said polyacrylamide beads in said upper pocket partitions, said lumbar vest portion containing said saturated polyacrylamide beads forming a lumbar support vest portion.

7. A vest apparatus improved for providing temporary cooling comfort to a human wearer as described in claim 6, wherein:

said transverse stitching arrangement forming an ornate design on said backside vest portion.

8. A vest apparatus improved for providing temporary cooling comfort to a human wearer as described in claim 5, further comprising:

a peripheral pocket partition formed about both vest arm opening portions, said peripheral pocket partition having an extended portion for contacting an underarm region of a user, said peripheral pocket partition containing a respective amount of said polyacrylamide beads for being saturated with a liquid.

9. A vest apparatus improved for providing temporary cooling comfort to a human wearer as described in claim 8, wherein:

said frontside vest portion being provided with an ornate design and utility pocket member.

10. A method of cooling an upper human torso, said method comprising the steps of:

(a) providing an improved cooling vest apparatus, said cooling vest apparatus comprising a frontside vest portion, a backside vest portion, opposing shoulder portions, said shoulder portions interconnecting said frontside vest portion to said backside vest portion, said interconnected frontside and backside vest portions defining a neck opening between said shoulder portions, said improvement comprising:

a double layer of non-impervious fabric shaped for constructing said frontside vest portion and said backside vest portion, said constructed frontside and backside vest portion each forming a respective inner fabric liner and outerwear fabric layer;

a stitching arrangement for joining said inner fabric liner to said outerwear fabric layer;

a plurality of elongated pocket partitions formed on said frontside and backside vest portions by said stitching arrangement, said pocket partitions defining a volume;

a pre-determined amount of polyacrylamide beads contained within each formed pocket partition, said amount of polyacrylamide beads being saturated with less than 1% by weight of a saturating liquid and being evenly distributed throughout each said formed pocket partitions and occupying less than 50% of said defined volume in each pocket partition, said polyacrylamide beads being porous and capable of further absorbing a liquid, through said non-impervious double layer fabric, and swelling to form a gel mass that fills 100% of said defined volume in each pocket partition;

a collar member attached to said backside vest portion about said neck opening, said collar member also being formed from a double layer of non-impervious fabric and having stitching delineating at least one pocket partition having a defined volume; and a pre-determined amount of said polyacrylamide beads contained within said at one pocket partition;

(b) depositing said provided cooling vest in water and causing said water to permeate said inner and outer fabric layer and saturate said polyacrylamide beads contained in said pocket partitions to form a swollen gel mass;

(c) cooling said cooling vest containing said swollen gel mass to a desired temperature below 20 degrees centigrade; and (d) wearing said cooled cooling vest by a human wearer to effect cooling his or her upper body torso.

11. A vest apparatus improved for providing temporary cooling comfort to a human wearer, said vest apparatus comprising:

a plurality of elongated pocket partitions on a frontside and a backside of said vest apparatus, said pocket partitions being formed from non-impervious fabric, said pocket partitions defining a volume;

a plurality of elongated mesh fabric strips sewn adjacent each said elongated pocket partitions by a stitching arrangement;

a pre-determined amount of polyacrylamide beads contained within each said formed pocket partition, said polyacrylamide beads being porous and capable of absorbing a coolable liquid through said non-impervious fabric and swelling to form a gel mass that occupies said defined volume.

12. A vest apparatus as described in claim 11, said vest apparatus further comprising:

a plurality of mesh fabric cross strips, said plurality of mesh fabric cross strips being sewn on said vest apparatus substantially orthogonal with respect to said elongated pocket partitions;

a pair of shoulder panel strips formed from highly absorbent fabric for enhancing dissipation of upward going body heat and absorption of body perspiration;

a collar member attached to a backside vest portion about a neck opening, said collar member also being formed from non-impervious fabric and having stitching delineating at least one pocket partition having a defined volume; and a pre-determined amount of said polyacrylamide beads contained within said at least one pocket partition.

13. A vest apparatus as described in claim 11, said vest apparatus further comprising:

a transverse stitching arrangement located on a backside vest portion of said vest apparatus, said transverse stitching arrangement delineating an upper back vest portion having upper pocket partitions and a lumbar vest portion having lower pocket partitions, and a greater amount of said polyacrylamide beads being contained in said lower pocket partitions than in said upper pocket partitions, such that in a saturated state, said polyacrylamide beads in said lower pocket partitions produce a greater, thicker mass of swollen polymer gel than said polyacrylamide beads in said upper pocket partitions, said lumbar vest portion containing said saturated polyacrylamide beads forming a lumbar support vest portion;

a peripheral pocket partition formed about both vest arm opening portions of said vest apparatus, each said peripheral pocket partition having an extended portion for contacting an underarm region of a user; and each said peripheral pocket partition containing a respective amount of said polyacrylamide beads for being saturated with a liquid.

14. A vest apparatus as described in claim 12, said vest apparatus further comprising:

a transverse stitching arrangement located on a backside vest portion of said vest apparatus, said transverse stitching arrangement delineating an upper back vest portion having upper pocket partitions and a lumbar vest portion having lower pocket partitions, and a greater amount of said polyacrylamide beads being contained in said lower pocket partitions than in said upper pocket partitions, such that in a saturated state, said polyacrylamide beads in said lower pocket partitions produce a greater, thicker mass of swollen polymer gel than said polyacrylamide beads in said upper pocket partitions, said lumbar vest portion containing said saturated polyacrylamide beads forming a lumbar support vest portion;

a peripheral pocket partition formed about both vest arm opening portions of said vest apparatus, each said peripheral pocket partition having an extended portion for contacting an underarm region of a user; and each said peripheral pocket partition containing a respective amount of said polyacrylamide beads for being saturated with a liquid.

15. A vest apparatus improved for providing temporary cooling comfort to a human wearer, said vest apparatus comprising:

a plurality of elongated pocket partitions on a frontside and a backside of said vest apparatus, said pocket partitions being formed by a sewing arrangement that selectively attaches a double layer of non-impervious fabric to define a volume;

a pre-determined amount of polyacrylamide beads contained within each said formed pocket partition, said polyacrylamide beads being porous and capable of absorbing a liquid through said non-impervious fabric and swelling to form a gel mass that occupies said defined volume;

and a pair of shoulder panel strips formed from highly absorbent fabric for enhancing dissipation of upward going body heat and absorption of body perspiration.

16. A vest apparatus as described in claim 15, said vest apparatus further comprising:

a collar member attached to a backside vest portion about a neck opening, said collar member also being formed from non-impervious fabric and having stitching delineating at least one pocket partition having a defined volume; and a pre-determined amount of said polyacrylamide beads contained within said at least one pocket partition.

17. A vest apparatus improved for providing temporary cooling comfort to a human wearer, said vest apparatus comprising:

a plurality of elongated pocket partitions on a frontside and a backside of said vest apparatus, said pocket partitions being formed by a sewing arrangement that selectively attaches a double layer of non-impervious fabric to define a volume;

a pre-determined amount of polyacrylamide beads contained within each said formed pocket partition, said polyacrylamide beads being porous and capable of absorbing a liquid through said non-impervious fabric and swelling to form a gel mass that occupies said defined volume;

a pair of shoulder panel strips formed from highly absorbent fabric for enhancing dissipation of upward going body heat and absorption of body perspiration;

a collar member attached to a backside vest portion about a neck opening, said collar member also being formed from non-impervious fabric and having stitching delineating at least one pocket partition having a defined volume; and a pre-determined amount of said polyacrylamide beads contained within said at least one pocket partition.

* * * * *